United States Patent [19]

Russo

[11] 4,149,718

[45] Apr. 17, 1979

[54] INTERLOCKING POOL BRIDGE SYSTEM

[76] Inventor: Joseph R. Russo, 457 Bert Ave., Trenton, N.J. 08629

[21] Appl. No.: 816,116

[22] Filed: Jul. 15, 1977

Related U.S. Application Data

[63] Continuation of Ser. No. 605,703, Aug. 18, 1975, abandoned, which is a continuation-in-part of Ser. No. 587,460, Jun. 16, 1975, abandoned.

[51] Int. Cl.[2] ..... A63D 15/00

[52] U.S. Cl. ..... 273/23

[58] Field of Search ..... 273/23; D34/3, 2, 14

[56] References Cited

U.S. PATENT DOCUMENTS

| | | | |
|---|---|---|---|
| 1,482,962 | 2/1924 | Banks | 273/23 |
| 2,817,525 | 12/1957 | Niemann | 273/23 |
| 3,576,324 | 4/1971 | Lareau | 273/23 |

FOREIGN PATENT DOCUMENTS

| | | | |
|---|---|---|---|
| 7466 of | 1884 | United Kingdom | 273/23 |
| 24591 of | 1898 | United Kingdom | 273/23 |
| 309768 | 4/1929 | United Kingdom | 273/23 |

*Primary Examiner*—Richard C. Pinkham
*Assistant Examiner*—T. Brown
*Attorney, Agent, or Firm*—Albert Sperry; Frederick A. Zoda; John J. Kane

[57] ABSTRACT

An interlocking billiard cue bridge head adapted to be fixedly mounted to a standard billiard cue bridge stick and including an interlocking capacity provided by a tab assembly integral to the bridge head which can conveniently interlock with the head of another similarly configured pool bridge to thereby effectively create a bridge capable of supporting a cue stick at selectively variable heights which can be greater than the height at which either bridge head is capable individually.

9 Claims, 8 Drawing Figures

INTERLOCKING POOL BRIDGE SYSTEM

This application is a continuation of my co-pending application Ser. No. 605,703 filed Aug. 18, 1975, now abandoned, which itself is a continuation-in-part of application, U.S. Ser. No. 587,460 filed June 16, 1975, now abandoned.

BACKGROUND OF THE INVENTION

1. Field of the Invention

The present invention pertains to all forms of billiard games such as pool, billiards, snooker, etc., in which balls on a table are struck by cue sticks. The present invention has applications in other types of games but is most particularly adaptable to use in billiard - type games.

In particular, a bridge is the device which is used by a billiard player when there is an obstruction immediately adjacent to the ball which he desires to strike. The most usual obstruction is other billiard balls. These obstructions inhibit the billiard player from properly placing his hand on the table and guiding the cue stick as he so desires with his hands. However, if there were a manner for placing the guiding means for the cue stick at an elevation above the table, the player could easily shoot over intervening obstructions. This elevation can be accomplished by the use of a standard bridge or similar structure.

2. Description of the Prior Art

Previous attempts to provide a bridge extension which forms a secure guiding means at an elevation higher than the length of the bridge have proved unsuccessful. Examples of such attempts are U.S. Pat. Nos. 3,576,324 to Lareau; 898,345 to Farnham; 968,187 to McIntire; 1,299,720 to Harrison; and 1,482,962 to Banks. Each of these patents discloses a bridge configuration designed to be usable to guide a cue stick over intervening articles. These patents all have various metal elements which extend in many directions and, as such, might have a tendency to tear the felt surface of the table especially when considering the extremely usage which these bridge heads receive when used in commercial billiard establishments.

Most modern pool tables have racks which run along the length of the table to retain the billiard cue bridges when not in use. Often in commercial establishments the billiard cue is hurriedly placed in the rack and ends up being struck against the billiard table legs or dropped on the floor. This harsh usage makes the use of complicated or sophisticated structures impossible. Therefore a need arises for a simple structure which is able to be used to accomplish the same extending bridge position and yet withstand this harsh punishment.

In the past, whenever an extended vertical position was required for a bridge, a billiard player would take two standard billiard bridges and hold them together with one hand. In this manner, the two rounded handles would be gripped by one hand and one of the round guide means located on the end of the top bridge would be placed on top of the round wooden shaft immediately behind the bridge head of the lower bridge. The billiard player would then firmly squeeze the two handles to attempt to restrict the movement of the top bridge head which is mounted on the top of the cylindrical shaft of the lower bridge head. Sometimes this cumbersome configuration will be effective, however, whenever the player lacks the strength required to squeeze together the two bridge handles firmly or if the contacting surfaces of the upper bridge head and the lower bridge head stick are not tight enough then the circular guide means which is mounted on the cylindrical bridge shaft will move during the execution of the shot and thereby inhibit play.

To fully understand the great importance and advantages of the present invention one must know that when a player of pool or snooker has a turn at the table, he is determined to try to stay there as long as necessary without missing a shot or making a foul play in order to win the match. At the same time the opponent must wait for a turn at the table which many times never comes about.

Among the different games in pocket billiards are nine ball, bank pool, straight pool, one pocket eight ball, and golf pool. There are many times when the use of two bridges are necessary to help a player hit a ball or execute a shot such as when other balls are in the path of the cue ball (shooter). Many times as many as three, four, five, six, or seven balls are in a row such that with the inferior, outdated bridges in use today it would be impossible to execute a shot or pocket a ball with any degree of accuracy (i.e. positioning the cue ball for another play) while at the same time avoiding a foul play. The player making the foul play loses his turn at the table which many times may prove disastrous.

With the introduction of the present invention all the hazardous situations aforementioned will cease to exist. A player may be more assured knowing that many shots and safety plays and maneuvers which were before considered impossible, are now executed with ease and accuracy.

The games of pocket billiards and snooker will be greatly improved both offensively and defensively along with much better playing ability for all players throughout the world.

SUMMARY OF THE INVENTION

The present invention provides a simple and yet fully functional apparatus for providing a common bridge head guiding structure at a height off the pool table higher than is normally possible with a standard pool cue bridge head. A bridge head plate is provided with at least one guiding slot of a particular configuration to facilitate mating with a tab assembly of another similarly configured bridge head. The tab structure can be mounted upon the rear surface of the bridge plate and has protruding therefrom tabs which are adapted to mate with a slot in another bridge head which has a particular configuration for mating therewith. In particular the male tab member and the female guide slot member can be of a rectangular configuration to thereby facilitate mating. In operation one bridge head is placed upon another bridge head with the tab means of the first bridge head interlocking with the receiving slot of the second bridge head such that they are securely mounted upon one another and thereby provide a firm and stable bridge guide slot at a higher elevation off the table than is possible with either bridge head individually. The receiving slot can be located in the curved undersurface of the bridge head such that variable extended vertical heights are made possible when a male tab means extends both laterally and vertically from the head. In another alternative embodiment the side of the bridge head can have an extended vertical portion in order to increase the length of the contact surface between the pool table and the lower edge of the bridge to thereby increase the stability of the overall structure when in use singly or doubly.

It is an object of the present invention to provide a stable billiard bridge structure capable of use at extended distaines from the surface of the pool table.

It is another object of the present invention to provide an interlocking pool cue bridge head structure which provides a strong interlocking capacity between two adjacent bridge heads.

It is an object of the present invention to provide a pool cue bridge head structure which can withstand very harsh treatment such as it receives in commercial pool and billiard establishments.

It is an object of the present invention to provide an extremely simple and easy to produce inexpensive pool cue bridge head which can interlock with similar pool cue bridge heads for use at a height which is greater than the height possible when using a single bridge head individually.

It is another object of the present invention to provide a pool cue bridge head structure with an extended vertical edge thereof to increase the stability whenever single or multiple interlocking bridge heads are used.

It is an object of the present invention to provide a pool cue bridge head structure which can be used when three or more balls are directly in front of the ball which the player desires to hit.

It is another object of the present invention to provide interlocking billiard cue bridge head structure with snugly fitting and firmly interlocking structures between two bridge heads when one is placed on top of another to shoot over intervening structures.

It is still a further object of the present invention to provide an interlocking bridge head structure which can shoot over as many as seven balls in a row without causing a foul play.

It is still a further object of the present invention to provide a billiard cue bridge head structure which will not scratch or mark a billiard cue used therewith.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 2:
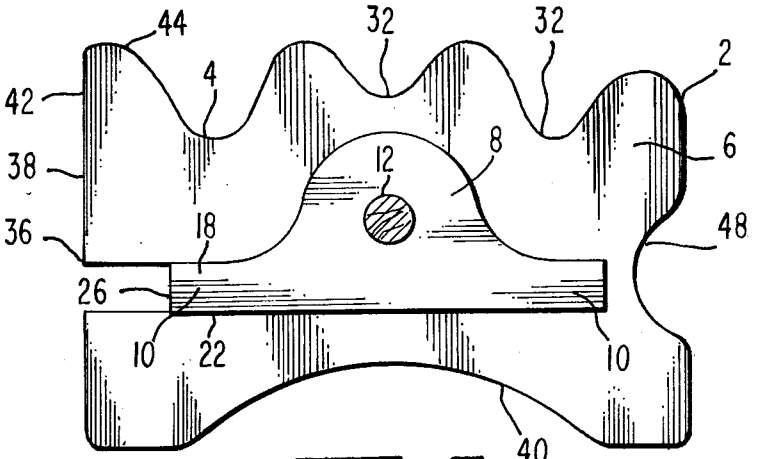
FIG. 2 is a plan view of the rear surface of one embodiment of the present invention.

In a preferred embodiment of the present invention the billiard cue bridge head includes a plate member 2 having a plurality of guide means 4 located about the periphery thereof. The rear surface 6 of the plate member 2 has mounted thereon a tab means 8. The tab means includes tab elements 10 which protrude in opposite directions from the center of the tab means. Tab means 8 defines in the center thereof an aperture 12 which is adapted to receive a plastic or wooden stick member or handle such as shown at 14 to facilitate use of the bridge. The plate member 2 can be chosen with a tab receiving means 16 having a rectangular female slot configuration which facilitates interlocking with the tabs 10 of the tab means 8 of another similarly configured bridge head. The interlocked position is fully illustrated in FIG. 4 and FIG. 5.

The present invention is a distinct improvement over the basic billiard cue bridge head design which has been used for many years in association with various billiard games. In With the common bridge head, it is difficult to shoot over more than one or two standard size billiard balls. However, as apparent from FIG. 5 the present invention provides a stable bridge head structure which can be used at a substantially elevated height and thereby shoot over as many as seven or more balls. In an embodiment of the present invention the stability of the interlocking configuration is achieved by the rectangular form of male tab elements 10.

Element 10 is chosen with a width slightly less than the width of rectangular slot or tab receiving means 16 such that when two bridge heads are interlocked a snugly fitting engagement will occur between slot 16 and element 10. In this position the top surface 18 of element 10 will contact the top surface 20 of slot 16. Similarly, the bottom surface 22 of tab 10 will contact the bottom surface 24 of slot 16. During movement into the interlocking position side 20 will slide along surface 18 and side 24 will slide along surface 22 until the end section 26 of the element 10 abuts the bottom section 28 which if formed by plate member 2 and tab means 8. In this manner a stable interlocked structure is maintained. In addition the stability of the intersection is increased by arcuate section 30 of tab means 8. As one bridge head is slidably mounted upon another bridge head the width of slot 16 will become less than the slowly increasing width of male member 10 due to the arcuate surface 30 which connects two male members 10 of each tab means 8. In this manner pressure is exerted outwardly on edges 20 and 24 to firmly secure the male element 10 defined by surfaces 18, 22 and 26 within the slot 16 which is defined by surfaces 20, 24 and 28.

Figure 3:
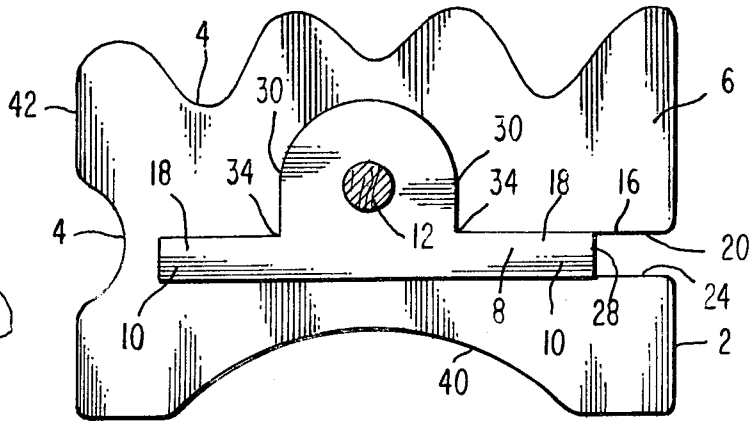
FIG. 3 is a plan view of the rear surface of another embodiment of the present invention.

In another embodiment of the present invention as shown in FIG. 3, the slot which is mated with male element 10 can be chosen to be on either side of tab means 8 and the arcuate surface 30 of tab means 8 can be chosen to evenly flow into the flat surface 18 or it may be chosen to intersect perpendicularly with surface 18 as shown in FIG. 3 at right angular intersection point 34. In the configuration with intersection point 34 it is apparent that the protruding edge 36 of plate 2 will move into snugly fitting contact with point 34 since the plate at edge 36 and the tab means at point 34 form mated rectangular configurations. In this structure the arcuate surface 30 forms a surface for abutment against which edge 38 of plate 2 will rest.

The guides 4 are chosen with a general arcuate outline as shown in guide elements 32. The size of the arcuate guide means can be chosen of any convenient dimensions, however, usually the diameter of the billiard cue stick is fairly standard and is on the order of the same size as stick members 14. A curved indented section 40 can be chosen along the bottom surface of plate member 2 to facilitate the use of the disclosed billiard cue bridge head when abutting the billiard table rails or other structures which might normally inhibit the placement of the bridge were it not for the indented section 40.

Figure 1:
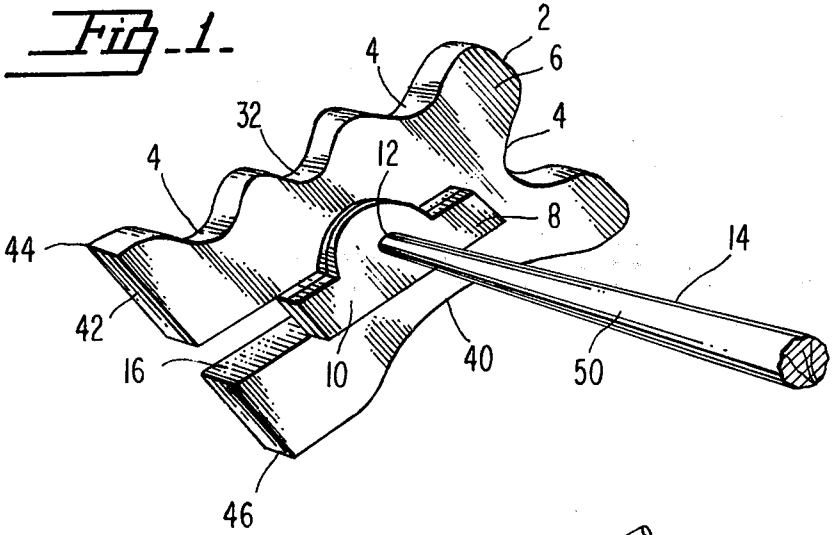
FIG. 1 is a perspective view of an interlocking billiard cue bridge head when mounted upon the bridge head stick.

From viewing FIG. 1 it is apparent that no element of tab means 8 protrudes laterally beyond the outline of plate at any time. In addition no portion of slot 16 protrudes beyond the outline of plate member 2. This is one of the distinct advantages of the present invention over the prior art since the prior art had various types of metallic strip elements and other complicated types of apparatus which extended well beyond the outline of the main plate member such that these elements could be easily bent or rendered inoperative, especially when considering the very rough usage to which these bridge heads are exposed. Therefore, the present invention has no protruding edges which may be broken or chipped to tear the felt table top or mar the appearance of the bridge head or render it inoperative.

An embodiment may be chosen with a protruding edge 42 which greatly increases the stability which is required when resting a billiard cue against the bridge at such an extended distance from the surface of the table. By extending this edge 42 vertically as far as top edge 44, the distance between top edge 44 and bottom edge 46 is greater than in a standard bridge cue system and thereby provides the increased stability required for such a taller bridge than has heretofore been commonly used. It is this increased distance between points 44 and 46 which provides the added stability since a wider footing is thereby provided for contact with the table and wobbling or slipping is hence prevented.

Another problem which has heretofore plagued professional billiard and pool players has been the marring of expensive pool sticks by metallic or hard plastic bridges. In this respect the present invention includes the use of nylon or plastic materials for forming tab elements 8 and plate elements 2 such that when a billiard cue is sliding through guides 4 there will be no marring of the expensive cue sticks which often are made of wood.

Figure 5:
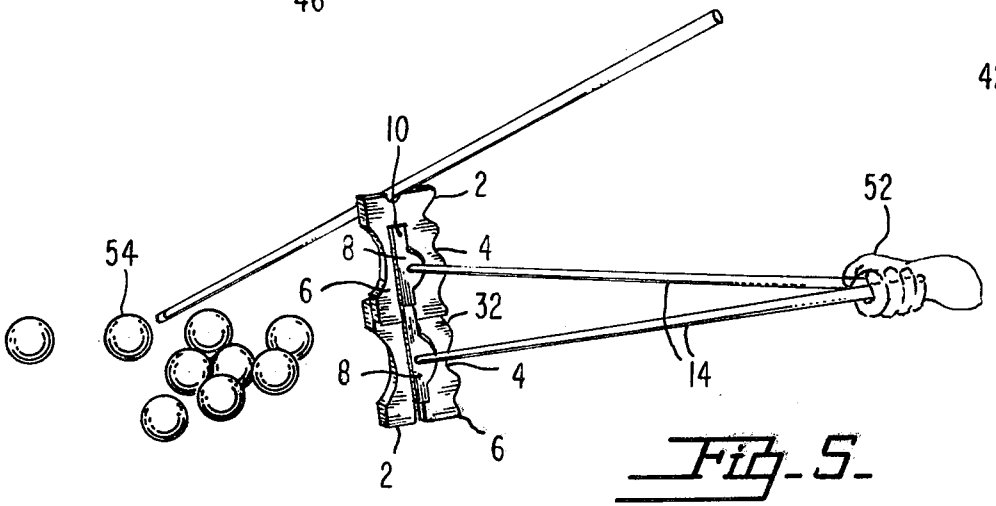
FIG. 5 is a view of the present invention utilizing the interlocking feature of two similarly configured billiard cue bridge heads.

In the prior, art operation at any extended distances from the surface was accomplished by mating a normally curved guide manner such as shown as 48 in abutment with the top surface 50 of the stick element 14 of the lower bridge. In FIG. 5 if the two bridge heads did not have the new inventive interlocking tab structure, it would be necessary for the person to squeeze with his hand 52 to compress round edge 48 with the round top surface 50 of stick 15. This is very difficult and requires a great deal of steadiness and strength and normally it is required to hold these two bridges in this difficult to maintain position for a period of time while the person lines up his particular shot. In addition once the shot has been completed it is necessary to remove both bridge heads from the surface immediately so that no ball which has been caused to move on the table will contact the bridge head. If this were to occur this would be a foul play and the player would be penalized. In the new structure disclosed in the present invention the interlocking tab means as shown in FIG. 5 requires no extra strength whatsoever to be exerted by the player's hand 52 but merely a loose and firm gripping of the stick members 14. In this respect there is no tension created in the player's arm or hand and he can take as long as desired to line up his shot of the ball which is desired to be hit as indicated at 54. Also once the shot has been made the player can simply lift upward with his hand 54 and easily pull both bridge heads off the table top surface in one quick motion since they are interlocked with one another and will not slidably disengage.

Figure 6:
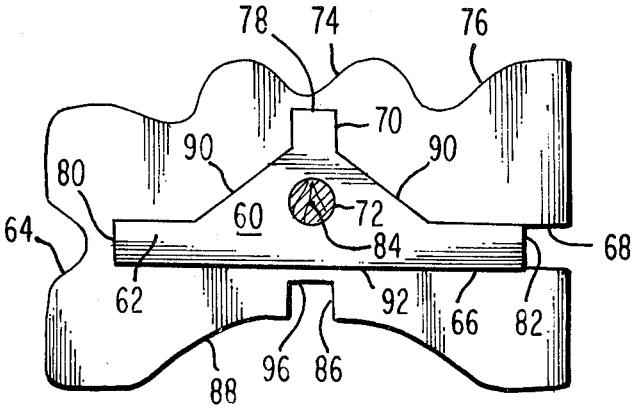
FIG. 6 is an alternative embodiment of the present invention showing a triple-membered male tab means and a bottom slot.

Another embodiment of the present invention is illustrated in FIG. 6 wherein an alternate configuration of the tab means 8 is shown as element 60. Element 60 has one male tab element 62 protruding laterally outward in the direction of arcuate guide means 64. Another male tab element 66 protrudes laterally outwardly opposite to element 62 in the direction of rectangular guide means 68. A third male tab element 70 extends upwardly in a line from aperture 72 to arcuate guide means 74. With this tab construction on the rear surface of plate number 76 we see that the distance between the far edge 78 of male element 70 from the center point 84 to the far edges 80 and 82 of male elements 62 and 66. With this construction, variations can be chosen in the vertical height which is available when two bridge heads embodying the present invention are utilized in the interlocked position.

To provide an increased element of variability, a slot means 86 is provided in the bottom surface of plate element 76.

In order to provide better stability, slot element 86 may be positioned centrally below the center 84 of aperture 72. When so positioned, slot 86 will be in the center of the lower arcuate section 88. The combination of usages available with the embodiment illustrated in FIG. 6 which utilizes the slot 86 in combination with the vertical male element 70 adds versatility to applications of the present invention. Two of the more standard interlocking positions which uses the embodiment shown in FIG. 6 are fully illustrated in FIGS. 7 and 8.

Figure 4:
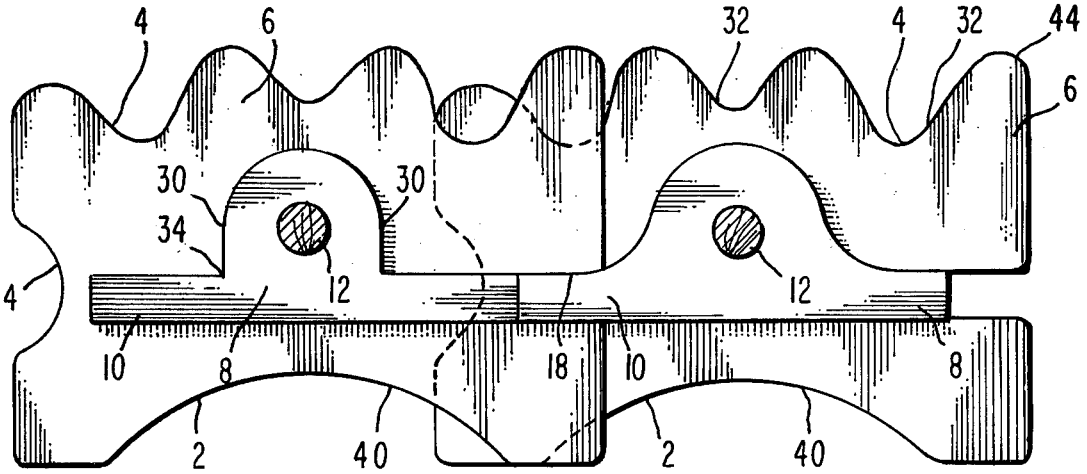
FIG. 4 shows the embodiments of FIGS. 2 and 3 when in the interlocked position.
Figure 7:
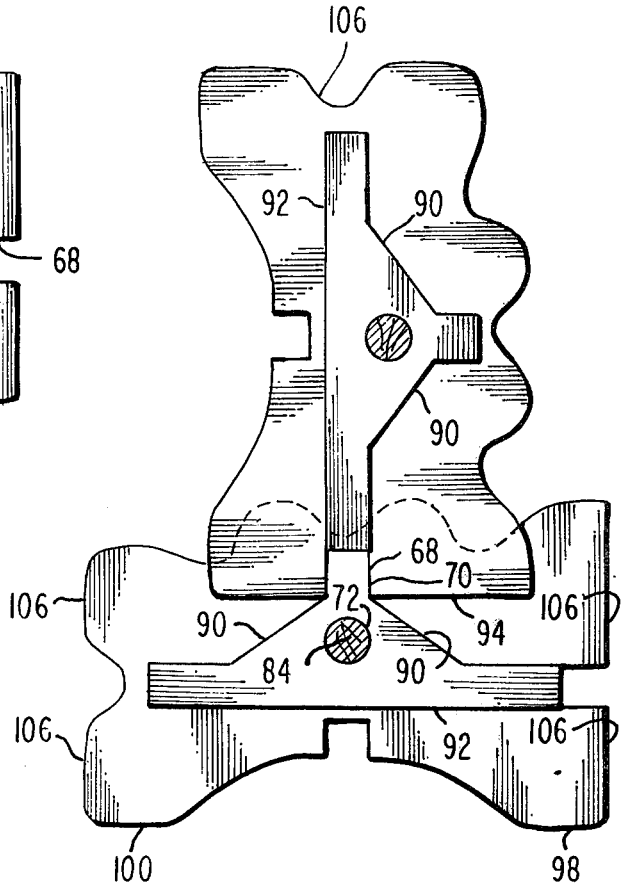
FIG. 7 shows two embodiments as in FIG. 6 in an interlocked position.

In particular, FIG. 7 shows the use of vertical male element 70 when interlocked with the rectangular guide means 68. In this configuration a vertical height is attainable which is greater than the height possible with the use of one standard bridge and yet is lower than the height possible by the use of two bridges interlocked end-to-end as shown in FIG. 4. This lower height is created because the difference between the center 84 of aperture 72 and the end side 82 of male element 66 is greater than the distance between the end 78 of male element 70 and the center 84 of aperture 72. Although it would be possible, of course, to use the FIG. 4 configuration to make any shot which can be made with the FIG. 7 configuration, it is more desirable to use the FIG. 7 configuration because it is lower and therefore closer to the table and the player can line up the shot better and keep the interface between the interlocked bridges and pool cue more steady during the execution of the shot. As such, it is always desirable to use the shortest possible bridging structure when executing a shot since better alignment and more stability are achieved thereby.

The surfaces which interconnect male tab elements 62, 66 and 72 are shown in this embodiment as straight inclined surfaces 90 and straight horizontal surface 92.

It is desirable that the surface 92 be straight, however, surfaces 90 can be chosen with a curved outline such that the intersection between the outline of edges 90 and the sides of vertical male tab element 70 form approximate angle of 135° to thereby increase the abutment surface between the edge 94 of plate number 76 and the contoured edge of surface 90. This same rigid abutment structure exists when the rectangular guide means 68 is used as the female interlocking component.

Figure 8:
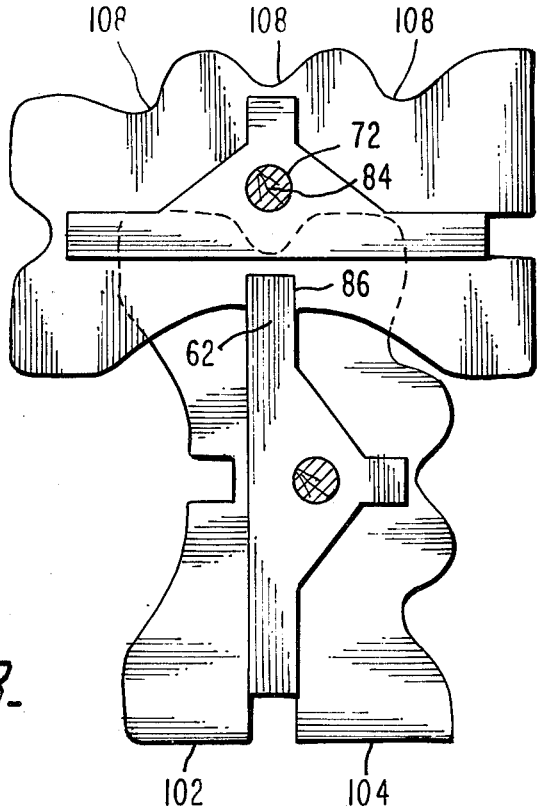
FIG. 8 shows two embodiments as in FIG. 6 in another interlocked position.

Another interlocking configuration using the bridge head shown in FIG. 6 is shown in FIG. 8 wherein the female slot 86 is used as the female interlocking component. Here a male lateral tab element such as 62 is extended upwardly into female slot 86. In this configuration, another variable height is possible since the distance between the center 84 of aperture 72 and the top edge 96 of slot 86 is different from the distance between center 84 and edges 78, 80 or 82. Therefore, another vertical height is possible which is greater than the height utilizing one bridge and less than the height when utilizing two bridges in the end-to-end configuration shown in FIG. 4.

The interlocking structure shown in FIG. 7 utilizing male tab elements 70 is approximately at the same height as the interlocking structure of FIG. 8 utilizing slot 86. Even assuming that the vertical distances possible using these two interlocking configurations were the same, there are distinct advantages in applications of each structure. In particular, the male element 70 interlocking structure of FIG. 7 can be used whenever increased stability is required since the distance between legs 98 and 100 is greater than the distance between edge section 102 and 104. Therefore, there is more lateral stability available in the FIG. 7 configuration. A disadvantage, however, of this interlocking structure is that only one guide means 106 is available in which to place the player's cue stick. Also, if there are structures laterally adjacent to the position on the table where the bridge will set, the sides of the lower bridge shown generally as 106 might interfere therewith.

In the FIG. 8 interlocked position, these two advantages are alleviated at the cost of some degree of stability. It is appreciated that the distance between edge 102 and edge 104 is less than the difference between leg 98 and leg 100 and therefore the FIG. 7 configuration is somewhat more stable. However, with certain ball positions the FIG. 8 interlocking structure will be required since the FIG. 7 structure would interfere with balls on the table or the side of the table. For example, if balls were laterally located from the point where the bridge is desired to set and the distance between the balls is less than the difference between edges 106 adjacent to leg 100 and edges 106 adjacent to leg 98, then the narrower lateral dimension of the FIG. 8 construction where it contacts the table will prove advantageous. In other words, the FIG. 8 structure can fit within narrower lateral limitations between balls and/or the edges of the table.

Another advantage of the FIG. 8 construction is that there are at least three guide means 108 from which the player can choose to place his cue stick. This lateral variation will often prove advantageous when a player desires to shoot over a ball or an edge of a table which is immediately to the left or right of where he wishes to place his cue stick.

One of the most important characteristics of the present design which must be appreciated at this point is the lack of maintenance requirements and the overall sturdiness of the construction. In particular, whenever a slidable or movable element is utilized within a bridge head the configuration has been shown to be unusable due to the very rough usage to which these bridge heads are put when in commercial establishments such as billiard rooms. The present design utilizes a completely *undetachable and immovable* tab structure in each single unitary bridge head which by definition has no movable parts, bars, slots, rods or tabs. With such a configuration the problems of breakage and maintenance existing in the heretofore structures of the prior art has been overcome. All of the prior art patents existing in this field deal solely with sliding tabs and movable rods and relocatable male and female members in order to provide some complicated configuration to hold a bridge head at an extended level above the pool table. These structures are particularly unsuitable for use in commercial establishments in comparison with the rugged sturdy structure of the present design.

While several particular embodiments of this invention have been shown in the drawings and described above, it will be apparent that many changes may be made in the form, arrangement, and positioning of the various elements of the combination. In consideration theeof, it should be understood that preferred embodiments of this invention disclosed herein are intended to be illustrative only and not intended to limit the scope of the invention.

I claim:

1. An interlocking billiard cue bridge head system comprising a plurality of bridge heads each including:

(a) a plate member;

(b) at least one guide means located around the periphery of said plate member for guiding movement of a billiard cue when abutting said plate member of the bridge;

(c) a tab means fixedly attached to said plate member and integral therewith and therefore completely undetachable and immovable with respect to said plate member; and (d) a tab receiving means adapted to receive therein said tab means from another of said bridges of said system to firmly interlock said bridge heads together to provide a combined bridging structure which when placed in contact with a pool table will provide a stable guide means at a height greater than possible by the use of either bridge solely.

2. The bridge head as defined in claim 1 wherein said tab receiving means is rectangular.

3. A bridge head as defined in claim 1 wherein said bridge head includes a handle fixedly attached to said tab means and said plate member.

4. The bridge head as defined in claim 1 wherein said plate member includes elongated edges thereof for providing extended table contact area for increased stability during movement of a billiard cue when in contact with said guide means of said plate member.

5. The bridge head as defined in claim 1 wherein said tab means is a male rectangular member and said plate member is a tab receiving means rectangular member.

6. The bridge head as defined in claim 1 wherein said tab means includes a shoulder for providing a surface against which said tab receiving means abuts when at least two of said bridge heads of said system are in interlocked position.

7. The bridge head as defined in claim 1 wherein said tab means comprises a flat edge, two male members and a curved edge opposite from said flat edge.

8. The bridge head as defined in claim 1 wherein said plate member and said tab means are made of plastic.

9. The bridge head as defined in claim 1 wherein said plate member and said tab means are made of nylon.

* * * * *